United States Patent [19]

Yamamura et al.

[11] 4,115,677

[45] Sep. 19, 1978

[54] INDUCTION HEATING APPARATUS

[75] Inventors: Hideo Yamamura, Nagoya; Katsuharu Matsuo, Aichi; Nobuyuki Nagai, Nagoya, all of Japan

[73] Assignee: Tokyo Shibaura Electric Co., Ltd., Kawasaki, Japan

[21] Appl. No.: 870,583

[22] Filed: Jan. 18, 1978

Related U.S. Application Data

[63] Continuation of Ser. No. 729,428, Oct. 4, 1976, abandoned.

[30] Foreign Application Priority Data

Oct. 2, 1975 [JP] Japan ..... 50/119181
Aug. 16, 1976 [JP] Japan ..... 51/97030

[51] Int. Cl.[2] ..... H05B 5/04

[52] U.S. Cl. ..... 219/10.49 R; 200/50 C; 219/10.77; 236/46 D; 307/41; 328/75; 338/131; 363/8

[58] Field of Search ..... 219/10.49, 10.75, 10.77, 219/485; 236/46 D; 200/50 C, 1 B; 307/11, 12, 38, 41, 112, 113, 115, 135, 139; 328/69–77, 79, 80, 81; 338/128, 130, 131, 334; 363/8, 9, 157, 177

[56] References Cited

U.S. PATENT DOCUMENTS

| | | | |
|---|---|---|---|
| 2,841,666 | 7/1958 | Anderson | 200/50 C |
| 2,932,715 | 4/1960 | Weeks | 219/485 |
| 3,558,924 | 1/1971 | Lindell | 328/75 |
| 3,925,633 | 12/1975 | Partridge | 219/10.77 |
| 3,955,061 | 5/1976 | Roehrman | 219/10.77 |

*Primary Examiner*—Bruce A. Reynolds
*Attorney, Agent, or Firm*—Cushman, Darby & Cushman

[57] ABSTRACT

An induction heating apparatus includes an inverter circuit, a plurality of output coils for induction heating, a coil selection circuit for selectively connecting the output coils to the output terminal of the inverter circuit, and a control circuit for driving the coil selection circuit and inverter circuit so as to cyclically supply the output of the inverter to any selected one of the output coils for each predetermined time of a predetermined cycle. The induction heating apparatus further includes a plurality of output adjusting means for setting the output period of the respective output coils which is included in the predetermined cycle.

8 Claims, 10 Drawing Figures

INDUCTION HEATING APPARATUS

This is a continuation, of application Ser. No. 729,428 filed Oct. 4, 1976, now abandoned.

BACKGROUND OF THE INVENTION

This invention relates to an induction heating apparatus adapted to sequentially energize a plurality of induction heating coils by the output of a single inverter circuit.

A conventional induction heating apparatus having a plurality of output coils for induction heating includes inverter circuits equal in number ot the output coils. The output coils are energized by the outputs of the corresponding inverter circuits. Since, however, such induction heating apparatus required the inverter circuits equal in number to the output coils, it is bulky and weighty and involves a high cost. Furthermore, since the apparatus is so designed as to supply the maximum output of the respective iverter circuits to the corresponding output coil, it is impossible to stop the operation of any one of the inverter circuits so as to make the maximum output of the other one of the inverter circuits twofold and thus the output of the corresponding output coil twofold.

It is accordingly the object of this invention to provide an induction heating apparatus capable of sequentially cyclically energizing a plurality of output coils for induction heating by the output of a single inverter circuit and capable of arbitarily setting the output of any selected output coil, i.e., the energization period of the output coil.

SUMMARY OF THE INVENTION

According to this invention there is provided an induction heating apparatus comprising an inverter circuit having an oscillator; a plurality of output coils for induction heating; an output coil selection circuit for selectively connecting each output coil to the output of the inverter circuit; and a control circuit for driving the output coil selection circuit and inverter circuit so as to cyclically supply the output of the inverter circuit to any selected one of the output coils for each selected time period of a predetermined cycle. The apparatus further includes a plurality of output adjusting devices for setting the output period of the respective output coil which is included in the predetermined cycle to a desired period.

If the maximum output of the inverter circuit is constant, the output coil generater an output corresponding to the energization period. For example, if the energization periods of three output coils are equal to each other, the outputs of the respective output coils have the same value. If the output period of the inverter circuit which is included in the predetermined cycle is constant and only one output coil selected is energized during the output period of the inverter circuit, the output of this selected output coil is very great. In this case, the output of the remaining output coils becomes substantially zero. That is, according to this invention the output of the single inverter circuit can be supplied to a selected one of the output coils or be distributed in a certain ratio to the output coils. Furthermore, despite the presence of the plurality of output induction coils the apparatus can be made compact and light in weight and the manufacturing cost per output coil can be lowered. If the apparatus according to this invention is provided with a total output regulating device for the respective output coil, it is possible to easily control the outputs of the output coils, i.e., the energization period ot the output coils.

Figure 2:
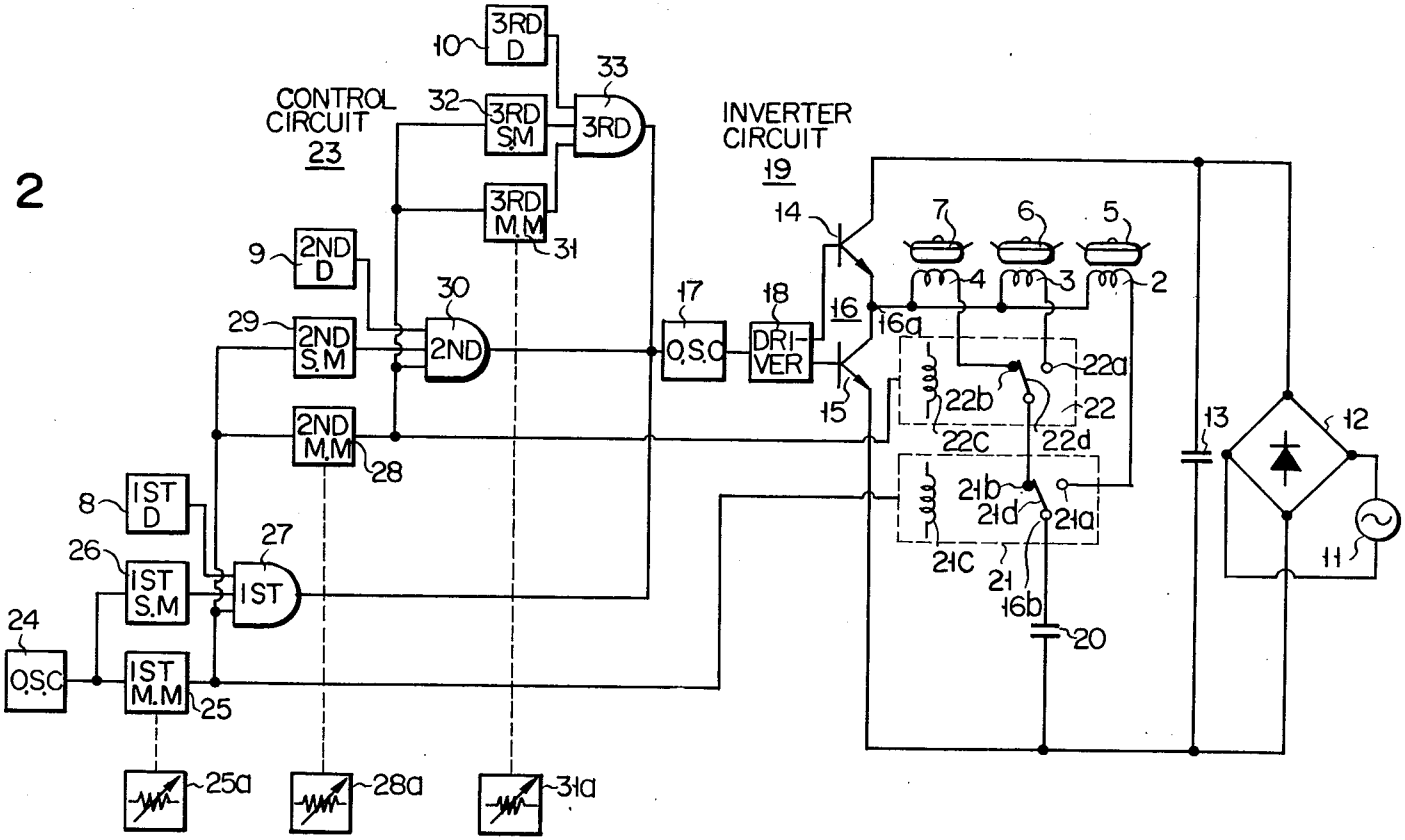
FIG. 2 is a circuit arrangement of the apparatus in FIG. 1.
Figure 10:
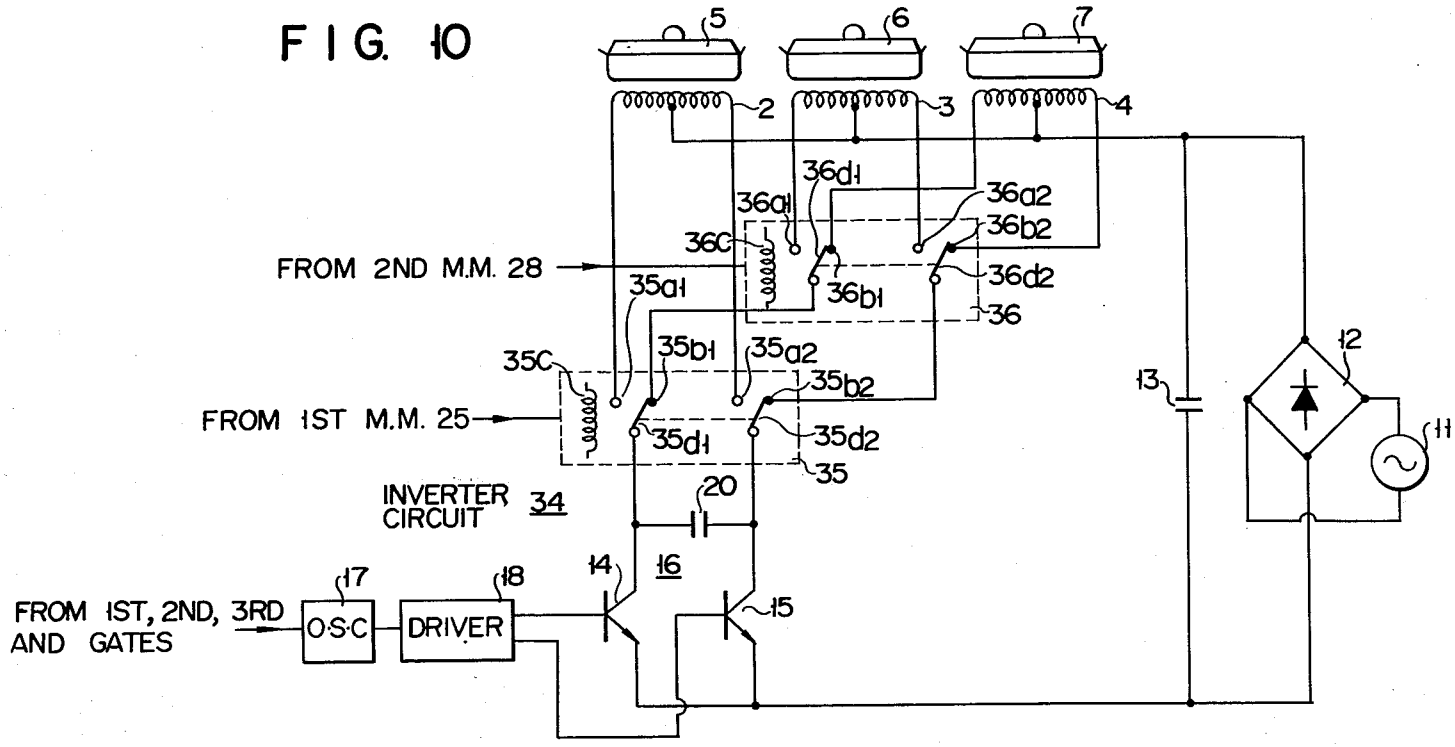
Figure 7:
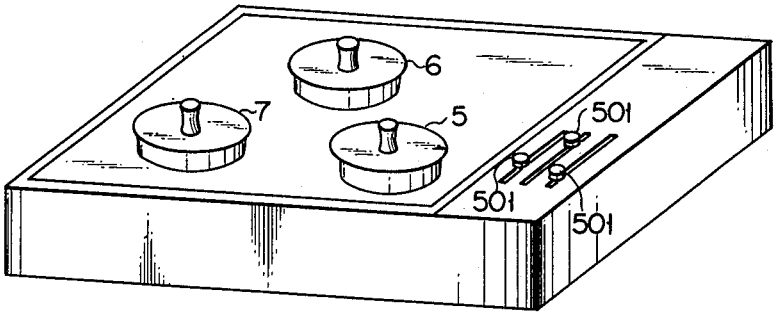
Figure 8:
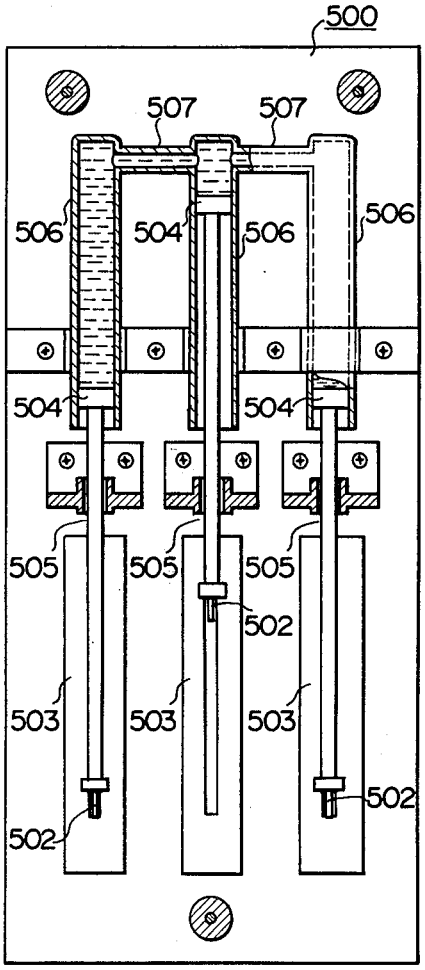
Figure 9:
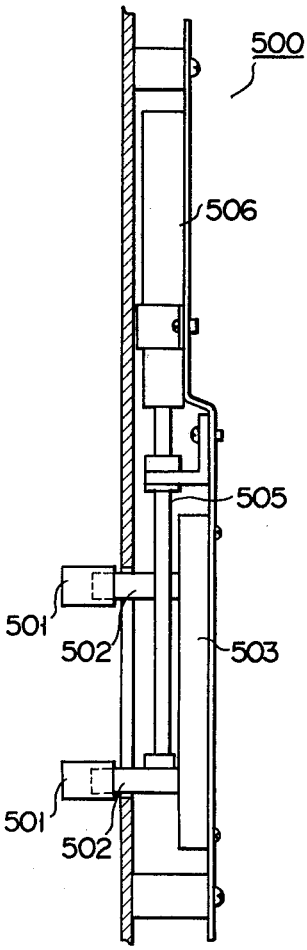

FI. 7 is a perspective view showing another embodiment of this invention;

FIG. 8 is a front view, partly in section, showing an interlocking mechanism of output adjusting knobs of output coils in FIG. 7;

FIG. 9 is a side view, partly in section, showing the interlocking mechanism in FIG. 8; and FIG. 10 is a circuit arrangement showing a modified form of an inverter circuit and output selection circuit in FIG. 2.

DETAILED DESCRIPTION OF THE PREFERRED EMBODIMENTS

Figure 1:
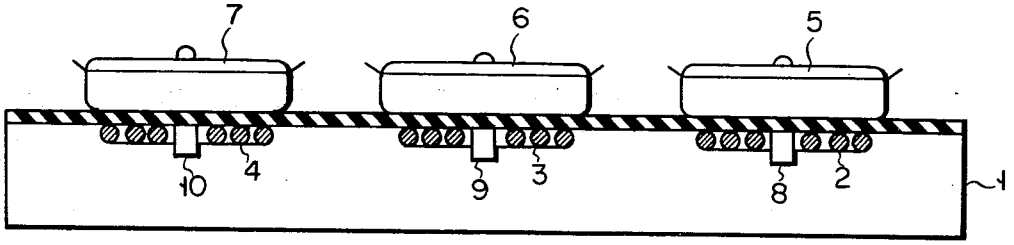
FIG. 1 is an outward view, partly in section, showing an apparatus according to one embodiment of this invention.

FIG. 1 shows an induction heating apparatus according to one embodiment of this invention. The induction heating apparatus includes an apparatus body 1; first, second and third induction heating output coils 2, 3 and 4 disposed at predetermined intervals in the apparatus body 1; to-be-heated articles, for example, first, second and third magnetic pans 5, 6 and 7 disposed on a heat-resistance insulating plate on the respective output coils; and load detectors 8, 9 and 10 adapted to detect whether the magnetic pan is set or not and deliver a detection signal when the magnetic pan is set. A control means of the output coils is shown by way of example in FIG. 2. The position of the control means in the apparatus body is not shown.

The control means includes output coil selection circuits 21, 22; a voltage switching type inverter circuit 19 including an output circuit 16; a control circuit 23 for driving the output coil selection circuits and an inverter circuit; an output adjusting device for setting the output of each output coil; and a total output regulating device adapted to control the total output of each coil in such a manner that it does not exceed a predetermined maximum value.

The output circuit 16 includes an AC power source 11, a full wave rectifying bridge 12 for full-wave rectifying the output of the power source, a capacitor for smoothing a rectifying output 13, first and second NPN type power transistors 14 and 15 serially connected across the capacitor 13, and a tuning capacitor 20 connected between the emitter of the power transistor 15 and one output **16*b* of the output circuit 16. The other output terminal of the output circuit 16 is a conjunction 16a of the emitter of the transistor 14 and the collector of the transistor 15. The inverter circuit 19 includes, in addition to the output circuit 16, a high frequency oscillation circuit 17 and a driver 18 adapted to deliver an output to the bases of the power transistors 14 and 15 in response to the output of the high frequency oscillation circuit and alternatively control the power transistors in an ON-OFF fashion. The coil selection circuits comprise, for example, first and second relays 21 and 22. The first relay 21 includes a normally open contact 21***a*, a normally closed contact 21*b*, a lever 21*d* connected to the one output terminal 16*b* of the output circuit 16 for permitting the contacts 21*a* and 21*b* to be switched from one to the other, a drive coil 21*c* for effecting the switching of the contacts and a circuit (not shown) for energizing the drive coil. The second relay 22 includes a normally open contact 22*a*, a normally closed contact 22*b*, a lever 22*d* connected to the normally closed contact 21*b* of the first relay 21 for permitting the contacts 22*a* and 22*b* to be switched from one to the other, a drive coil 22*c* for effecting the switching of the contacts and a circuit (not shown) for energizing the drive coil. One end of each output coil 2, 3 or 4 is connected in common to the other output end 16*a* of the output circuit 16 and the other ends of the output coils 2, 3 and 4 are connected to the normally open contact 21*a* of the first relay, normally open contact 22*a* of the second relay and normally closed contact 22*b* of the second relay, respectively.

The control circuit 23 has a low frequency oscillator 24 for generating a pulse of short width $T_P$ for every relatively long cycle $T_O$. The output of the low frequency oscillator 24 is connected to the input of a first main monostable multivibrator 25 (hereinafter referred to as a main monomultivibrator) and a first subsidiary monostable multivibrator 26 (hereinafter referred to as a subsidiary monomultivibrator). The output of the first main monomultivibrator 25 is connected to the input of the energizing circuit (not shown) for energizing the coil 21c of the first relay 21 and to one input terminal of a first three-input terminal AND gate 27. The outputs of the subsidiary monomultivibrator 26 and first load detector 8 are connected to the other input terminals of the first AND gate 27. The output of the first main monomultivibrator 25 is also connected to a second main monostable multivibrator 28 (hereinafter referred to as a second main monomultivibrator) and second subsidiary monostable multivibrator 29 (hereinafter referred to as a second subsidiary monomultivibrator). The output of the second main monomultivibrator 28 is connected to the input of the energizing circuit (not shown) for energizing the coil 22*c* of the second relay 22 and to one input of a second three-input terminal AND gate 30. The outputs of the second subsidiary monomultivibrator 29 and second load detector 9 are connected to the other input terminals of the second AND gate 30. The output of the second main monomultivibrator 28 is also connected to a third main monostable multivibrator 31 (hereinafter referred to as a third main monomultivibrator) and third subsidiary monostable multivibrator 32 (hereinafter referred to as a third subsidiary monomultivibrator). The outputs of the third main monomultivibrator 31, third subsidiary monomultivibrator 32 and third load detector 10 are connected to the respective inputs of a three terminal AND gate 33. The outputs of the first, second and third AND gate 27, 30 and 33 are connected to the input of the high frequency oscillation circuit 17. The first, second and third main monomultivibrators 25, 28 and 31 generate respective output pulses of predetermined time widths. The output of the first, secnd and third main monomultivibrators 25, 28 and 31 rises in synchronism with the fall of input signals. The pulse widths of the output pulses can be arbitarily set by variable resistors 25*a*, 28*a* and 31*a* in the main monomultivibrators 25, 28 and 31. The outputs of the first, second and third subsidiary monomultivibrators 26, 29 and 32 fall in synchronism with the fall of its respective input signals and become zero only during a short time period, respectively. The high frequency oscillation circuit 17 oscillates only during the period in which any of the outputs of the respective AND gates 27, 30 and 33 are supplied.

The operation of the induction heating apparatus according to the embodiment of this invention will be explained below. In explanation, "1"0 shows the presence of a signal "1" and "0" shows the absence of a signal.

Figure 3:
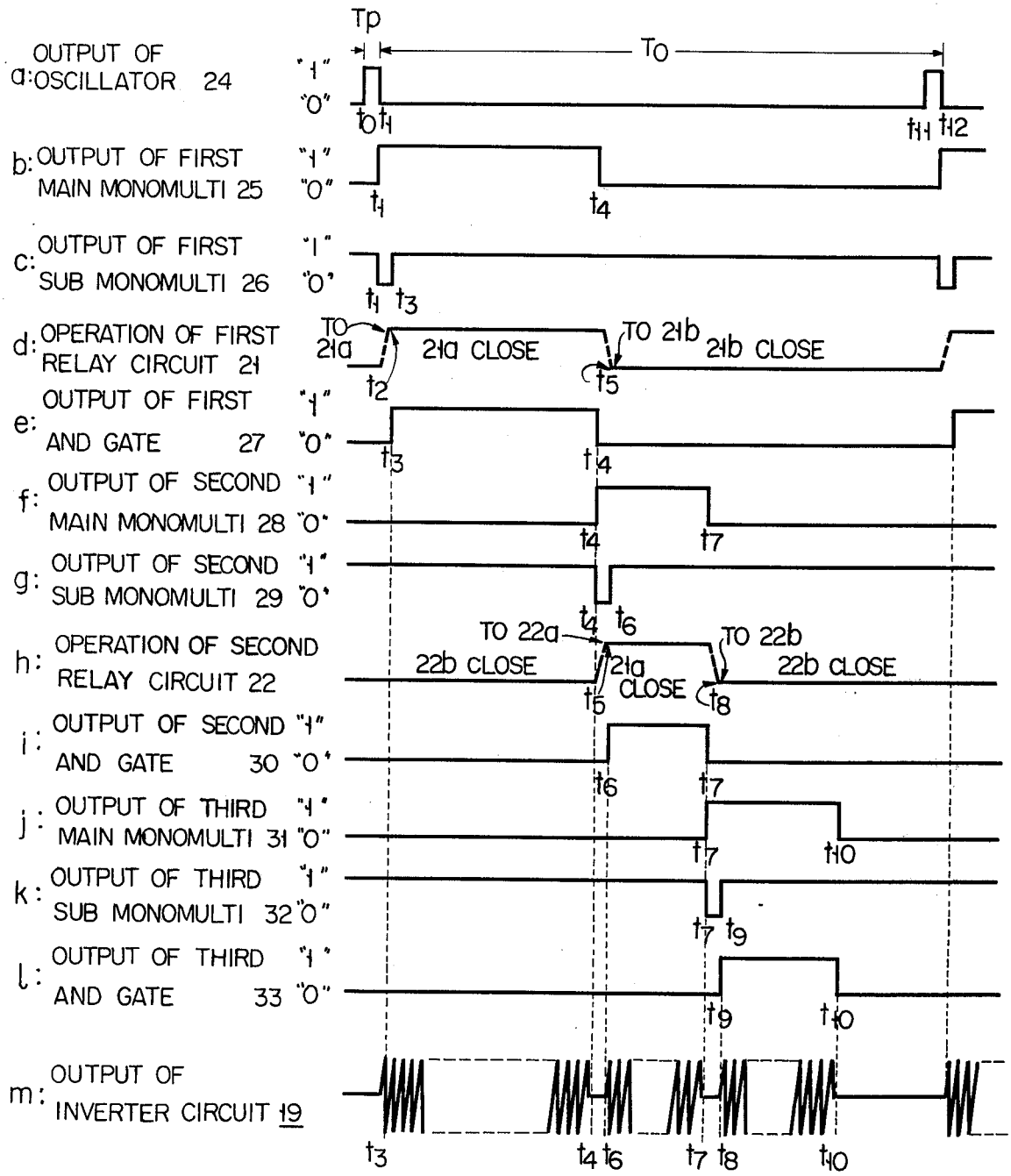
FIG. 3 is a time chart showing the operation timing of each part of the apparatus in FIG. 1.

The low frequency oscillator 24 generates an output pulse of width $T_P$ for each cycle $T_O$ as shown in FIG. 3 (*a*). Now suppose that the output pulse rises at time $t_0$ and falls at time $t_1$. Then, at time $t_1$ the first main nonmultivibrator 25 generates an output "1" as shown in FIG. 3(*b*) and the output of the first subsidiary monomultivibrator 26 becomes "0" as shown in FIG. 3(*c*). In this case, the output "1" state of the first monomultivibrator 25 is continued for a predetermined time, for example, time $t_1$ to $t_4$ and the output "0" state of the first subsidiary monomultivibrator 26 is continued for a brief time, for example, time $t_1$ to $t_3$. During the time period in which the first monomultivibrator 25 is in the output "1" state, the first relay 21 is energized. As shown in FIG. 3(*d*) at time $t_2$ the lever 21*d* of the changeover switch has the normally open contact 21*a* closed with a predetermined mechanical delay. Now suppose that the first magnetic pan 5 is set over the first output coil 2. In this case an output indicating the "set" state of the pan 5 is fed from the first load detector 8 to the AND gate 27. The AND gate 27 assumes an output "1" state from time $t_3$ as shown in FIG. 3(*e*) to cause oscillation of the high frequency oscillation circuit 17. By this oscillation the inverter circuit 19 generates an output. The output of the inverter circuit is supplied to the output coil 2 to cause the first magnetic pot to be heated. At time $t_1$ the first relay 21 is energized by the first main monomultivibrator 25 to cause the lever 21*d* to be switched from the normally closed contact 21*b* to the normally open contact 21*a*. During the switching the first subsidiary monomultivibrator 26 is at the output "0" state and the first AND gate 27 is at the output "0" state. In consequence, the inverter circuit 19 generates no output during a time period $t_1$ to $t_3$ and the relay permits a sufficient switching from the contact 21*b* to the contact 21*a*. When at time $t_4$ the output of the first main monomultivibrator 25 falls from a level "1" to "0", the output of the second main monomultivibrator 28 becomes "1" in synchronism with the fall of the first main monomultivibrator output as shown in FIG. 3(*f*) and the output of the second subsidiary monomultivibrator 29 becomes "0" as shown in FIG. 3(*g*). In this case, the output "1" state of the second main monomultivibrator 28 is continued for a predetermined time, for example, time $t_4$ to $t_7$ and the output "0" state of the second subsidiary monomultivibrator 29 is continued for a brief time, for example, $t_4$ to $t_6$. At time $t_4$ the output of the first main monomultivibrator 25 becomes "0" and at the same time the high frequency oscillation circuit 17 stops its oscillation and the first relay 21 is deenergized. When the relay 21 is deenergized, at time $t_5$ the lever 21*d* of the changeover switch causes its normally closed contact 21*b* to be closed with a mechanical delay as shown in FIG. 3(*d*). That is, the lever 21*d* is returned to the original position. When on the other hand, at time $t_4$, the output of the second main monomultivibrator 28 becomes "1" and at the same time the second relay 22 is energized, at time $t_5$ the lever 22*d* of the changeover switch causes its normally open contact 22*a* to be closed with a mechanical delay as shown in FIG. 3(*h*). Now suppose that the second magnetic pot 6 is set over the second output coil 3. In this case, an output indicating the "set" state of the second magnetic pot 6 is delivered from the second load detector 9 to the second AND gate 30. The second AND gate 30 assumes an output "1" state from time $t_6$ as shown in FIG. 3(i) to cause oscillation of the high frequency oscillation circuit 17. That is, the inverter circuit 19 generates an output. The output of the inverter circuit 19 is supplied to the second output coil 3, causing the second magnetic pan 6 to be heated. When the second output coil 3 is energized, the first relay 21 causes the lever 21*d* to be switched to the normally closed contact 21*b*, since at time $t_4$ the output of the first monomultivibrator 25 becomes "0". Since at time $t_4$ the output of the first monomultivibrator 25 becomes "0" the relay 21 is deenergized to cause the lever 21*d* to be switched to the normally closed contact 21*b*. At time $t_4$ the output of the secondary main monomultivibrator 28 becomes "1", causing the second relay 22 to be energized to permit the lever 22*d* to be switched to the normally open contact 22*a*. Since, however, at time $t_4$ to $t_6$ the second subsidiary monomultivibrator 29 is at the output "0" state, the output of the second AND gate, i.e., inverter circuit 19 becomes "0". At time $t_4$ to $t_6$ each relay permits a sufficient switching from one contact to another.

When at time $t_7$ the output of the second main monomultivibrator 28 falls from a level "1" to "0", the output of the third main monomultivibrator 31 becomes "1" in synchronism with the fall of the second main monomultivibrator as shown in FIG. 3(J) and the output of the third subsidiary monomultivibrator 32 becomes "0" as shown in FIG. 3(*k*). In this case, the output "1" state of the third main monomultivibrator 31 is continued for a predetermined time, for example, time $t_7$ to $t_{10}$ and the output " " state of the third subsidiary monomultivibrator 32 is continued for a brief time, for example, time $t_7$ to $t_9$. When at time $t_7$ the output of the second monomultivibrator 28 becomes "0", the high frequency oscillation circuit 17 stops its oscillation and the second relay 22 is deenergized and at time $t_8$ the lever 22*d* of the changeover switch is switched to the normally closed contact 22*b* with a mechanical time delay as shown in FIG. 3(*h*). That is, the lever 22*d* is returned to the original position. Now suppose that the third magnetic pan 7 is set over the third output coil 4. Then, an output indicating the "set" state of the third load detector 10 is delivered to the third AND gate 33. At time $t_9$ the output of the third AND gate 33 becomes "1" as shown in FIG. 3(*l*) to cause the high frequency oscillation circuit 17 to oscillate. As a result, the output of the inverter circuit 19 is supplied to the third output coil 4 to heat the third magnetic pan 7. When the third output coil is energized, since at time $t_7$ the output of the second main monomultivibrator 28 becomes "0", the second relay 22 is deenergized to cause the lever 22*d* to be switched to the normally closed contact 22*b*. Since at time $t_7$ to $t_9$ the output of the third subsidiary monomultivibrator 32 becomes "0", i.e., the output of the third AND circuit 33 becomes "0", the output of the inverter circuit 19 is maintained at the "0" level during the time $t_7$ to $t_9$. During the time period in which the inverter output is at the "0" level the relay permits a sufficient switching from one contact to another. When at time $t_{10}$ the output of the third main monomultivibrator 31 falls from a level "1" to "0", the high frequency oscillation circuit 17 stops oscillation.

In this way the output coils 2, 3 and 4 are sequentially energized according to the time widths of the output pulses of the first, second and third monomultivibrators 25, 28 and 31, permitting the corresponding magnetic pans 5, 6 and 7 to be heated. At time $t_{11}$ following a time $t_0$ after the first is oscillated from the low frequency oscillation circuit 24, the low frequency oscillation circuit 24 again generates a pulse of a pulse width $T_P$. At the time when the pulse falls, i.e., at time $t_{12}$ the output of the first main monomultivibrator 25 again becomes "1" and the output of the first subsidiary monomultivibrator 26 becomes "0".

The sequential energization of the output coils 2, 3 and 4 is repeated for each pulse oscillation cycle $T_O$ of the low frequency oscillation circuit 24, causing the corresponding magnetic pans 5, 6 and 7 to be heated cyclically. Consequently, during time periods $t_2$ to $t_4$, $t_6$ to $t_7$ and $t_9$ to $t_{10}$ as shown in FIG. 3 is load current is distributed, for each cycle $T_O$, through the respective output coils 2, 3 and 4 which constitute a load circuit of the inverter circuit.

In this way, the three output coils can be sequentially driven by the output of only one inverter circuit. Therefore, the apparatus can be made compact in size and light in weight as compared with conventional apparatus requiring three inverter circuits to drive three output coils. Furthermore, the apparatus as a whole can be manufactured at low cost. By adjusting the resistances of the variable resistors 25*a*, 28*a* and 31*a* the first, second and third monomultivibrators 25, 28 and 31 can be designed to have a proper output "1" endurance time. That is, the period during which the output coils 2, 3 and 4 are energized by the output of the inverter circuit can be arbitarily determined. In other words, the outputs of the respective output coils can be arbitarily determined. With $W_O$ representing the output of the inverter circuit 19 and $W_A$, $W_B$ and $W_C$ representing the average outputs of the respective output coils 2, 3 and 4, for example, it follows that $$W_A = W_O \times t_4 - t_3 / T_O$$

$$W_B = W_O \times t_7 - t_6 / T_O$$

$$W_C = W_O \times t_{10} - t_9 / T_O$$

Now suppose that three output adjusting devices are provided in which rotation knobs are mounted on the respective variable resistors 25*a*, 28*a* and 31*a* for resistance adjustment. In this case, the rotation knobs are used as output adjustment knobs for the respective output coils. If the time widths ($t_1$ to $t_4$), ($t_4$ to $t_7$) and ($t_7$ to $t_{10}$) of the output pulses of the first, second and third main monomultivibrators can be varied in a time range of 0 to $T_O$ by the rotation of the rotation knob, then the outputs of the respective output coils 2, 3 and 4 can be varied in a wide range of 0 to $W_O$. If the output of any output coil, for example, the output coil 2 is set to $W_O$, the respective variable resistors 25*a*, 28*a* and 31*a* are operated by the output adjustment knobs so that $t_4 - t_1 \simeq T_O$ $t_7 - t_4 = 0$ and $t_{10} - t_7 = 0.$ Since in this way all the output of the inverter circuit can be concentrated on one output coil, when it is desired to rapidly heat any specific magnetic pan, such a requirement can be met.

However, when a sum of the output "1" endurance times of the first, second and third monomultivibrators exceeds the predetermined cycle $T_O$, a problem arises. In the abovementioned embodiment the setting of the output time width of the first main monomultivibrator 25 is given a preference and then the outputs of the second and third main monomultivibrators 28 and 31 are generated. When a pulse is delivered from the low frequency oscillation circuit 24 during the time in which the output of the third monomultivibrator 31, for example, is at the level "1", the third output coil 4 is deenergized and the first output coil is energized. In doing so, however, the set output of the adjustment knob as indicated on its pointer is not in agreement with the actual output of the output coil, thus presents practical inconveniences. One solution to this problem is as follows. That is, a mechanical correction is given to the rotation angle of the output adjustment knob and a sum of rotation angles of the respective output adjustment knobs as measured from respective reference positions is so set that it is less than a predetermined maximum value. In this case, the whole output of the respective output coils 2, 3 and 4 is so set that it is less than $W_O$. For example, when the output of the first and second output coils 2 and 3 is $W_O/3$, i.e., $t_4-t_1/T_O \simeq t_7-t_4/T_O$ 167 ⅓, if the output adjustment knob of the third variable resistor 31*a* is so rotated that the output of the output coil 4 exceeds $W_O/3$, the adjusting knobs of the first and second variable resistors 25*a* and 28*a* are reverserotated mechanically so that the output of the first and second output coils 2 and 3 is less than $W_O/3$. In this case, a sum of the rotation angles of the three output adjustment knobs as measured from the reference positions are so set that it is less than the set maximum value. In the above-mentioned embodiment, during the operation of the relays 21 and 22 the inverter circuit 19 always stops its operation, permitting smooth switching from one contact to another in each relay. Furthermore, since the load current is not directly interrupted, there is no fear that the relay contact will be burned due to arc discharge. This prevents a short life of the relay. Furthermore, the high frequency oscillation circuit 17 in the inverter circuit 19 stops its oscillation during the output coil energization period in which the magnetic pan is not set over the output coil.

Figure 4:
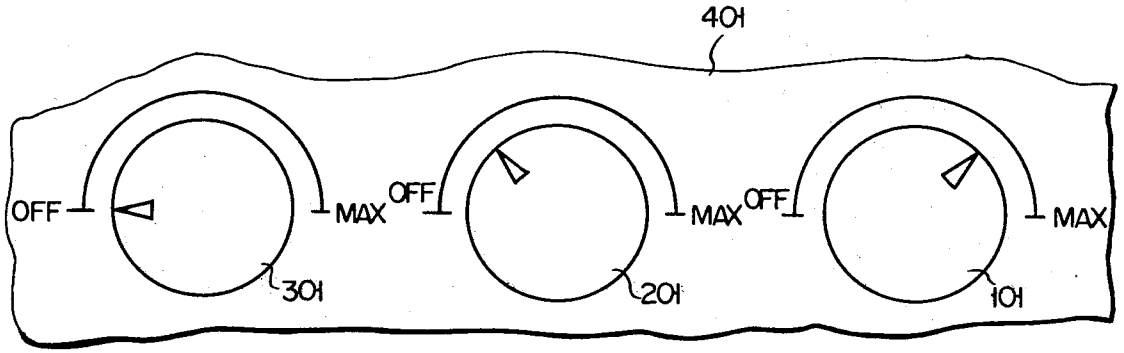
FIG. 4 is a front view showing an arrangement of output adjusting knobs of output coils in the apparatus in FIG. 1.
Figure 5:
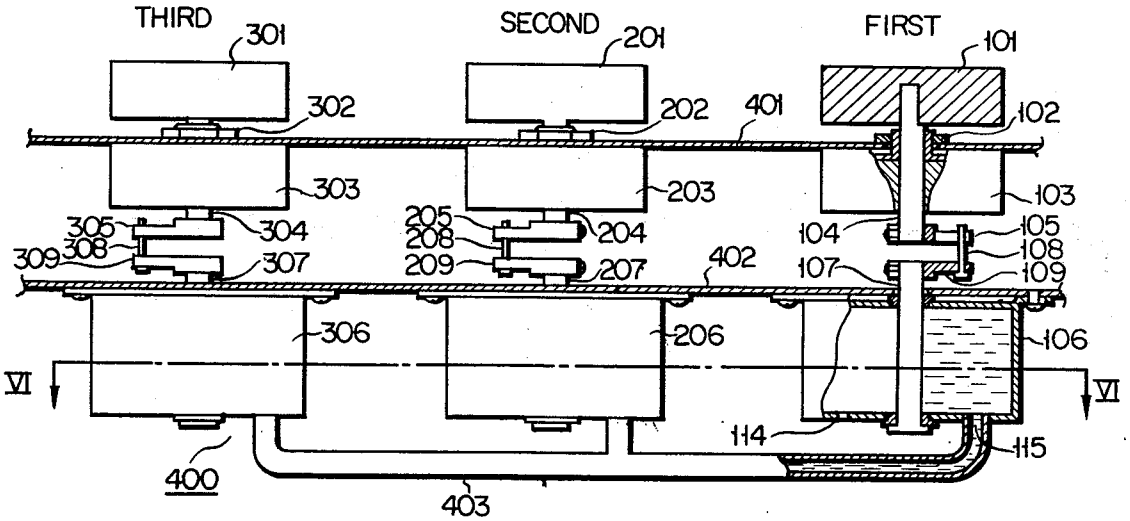
FIG. 5 is a side view, partly in section, showing an interlocking mechanism of the output adjusting knobs in FIG. 4.

FIGS. 4 and 5 show a rotation type interlocking mechanism 400 as a total output regulating device, i.e., an interlocking mechanism between the output adjustment knobs adapted to control the total of the rotation angles of the three output adjustment knobs so that it is less than the set maximum value.

Figure 6:
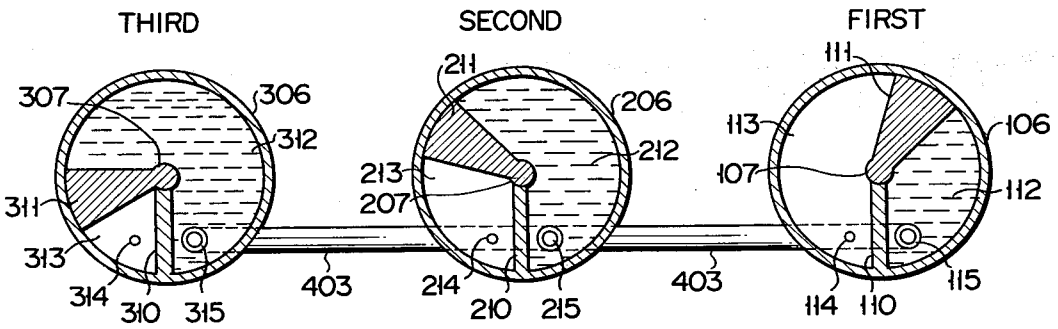
FIG. 6 is a cross-sectional view as taken along lines VI—VI of FIG. 5.

FIG. 4 is a front view showing the portion of the apparatus where the output adjustment knobs are mounted. On a display panel 401 are arranged in the following order a first output adjustment knob 101 for adjusting the first variable risistor 25*a*, a second output adjustment knob 201 for adjusting the second variable resistor 28*a*, and a third output adjustment knob for adjusting the third variable resistor 31*a*. There is provided on each knob a pointer for indicating the rotation angle as measured from a reference position (OFF), i.e., the output of each output coil. In each output adjusting knob of the rotation type interlocking mechanism 400, like reference numerals are employed to designate like parts. Since the output adjustment knobs are similar in structure to each other, the output adjustment knob 101 will be mainly explained by referring to FIGS. 5 and 6. In these Figures, 100 series numbers are used to designate each part corresponding to the first output adjustment knob 101, 200 series numbers are used to designate each part corresponding to the second output adjustment knob 201, 300 series numbers are used to designate each part corresponding to the third output adjustment knob 301, and 400 series numbers are used to designate the other parts. As shown in the cross-sectional view of FIG. 5, a rotation type first variable resistor 103 is mounted through a nut 102 on the rear surface of the display panel 401. The first variable resistor 103 has the first variable resistor 25*a* therein and includes a first operating shaft 104 extending through both the end surfaces of a resistor casing. One end of the first operating shaft 104 extend through the display panel 401 and a first output adjustment knob 101 is fixed to the extending end of the operating shaft 104. By rotating the first output adjustment knob 101 the resistance of the first variable resistor 103 can be directly varied, thereby adjusting the output of the first output coil 2. A first engaging element 105 is screwed to the other end portion of the first operating shaft 104 and extends in a direction perpendicular to the first operating shaft. A mounting plate 402 for the interlocking mechanism is disposed below the display panel 401 and a first cyclinder 106 is screwed below the mounting plate 402 and in a position corresponding to the first variable resistor 103. A first rotation shaft 107 extends through the center of the first cylinder 106 and it is rotatably mounted through a seal member. One end of the rotation shaft 107 extends upward through the mounting plate 402. A first power transmission element 109 is screwed into the extending end of the shaft 107 and a first engaging pin 108 is secured to the first power transmission element 109 in a direction parallel to the shaft 107. The first engaging pin 108 is engageable with the first engaging element 105 secured to the first operating shaft 104 to transmit a one direction rotation force from the first operating shaft 104 to the first rotation shaft 107 or from the first rotation shaft 107 to the first operating shaft 104. Within the first cylinder 106 a first partition wall 110 is integrally formed and it extends from the peripheral wall of the cylinder 106 toward the center of the cylinder 106 and reaches the first rotation shaft 107 as shown in FIG. 6. Within the first rotation shaft 107 a first rotor 111 is integrally secured so that it can be rotated in a manner to slidingly contact with the inner wall of the first cylinder 106. Two chambers are defined between the first rotor 111 and the first partition wall 110. An oil is filled into one chamber 112 and the other chamber 113 is occupied by air in the other chamber 113. In the bottom wall of the first air chamber 113 is provided an air hole 114 which is disposed in the neighborhood of the first partition wall 110. In the bottom wall of the first oil chamber 112 is provided a first oil supply hole 115 which is disposed in the neighborhood of the first partition wall 110. A communication pipe 403 communicates with the first oil supply hole 115.

The first oil chamber 112 of the first cylinder 106, second oil chamber 212 of a second cylinder 206 and third chamber 312 of a third cylinder 306 communicate with each other through the communication pipe 403. By rotating the output adjustment knobs through an angle of 0° to 180° starting with the reference point (OFF) the output of the output coil can be set to any value from 0 to the maximum output $W_O$. In this embodiment a sum of the rotation angles of all the output adjustment knobs can be always set to less than 180° and the actual output of the respective output coil and the set output of the respective output adjustment knob as represented by the rotation angle can be made to agree with each other.

The operation of the output adjustment device and locking mechanism 400, i.e., the maximum output regulating device will be explained more in detail below.

As shown in FIG. 4 the rotation angle of the first output adjustment knob 101 is 135° with the output of the first output coil 2 represented by $3W_O/4$; the rotation angle of the second output adjustment knob 201 is 45° with the output of the second output coil represented by $W_O/4$; and the rotation angle of the output adjustment knob 301 is 0° with the output of the third output coil 4 represented by 0. This is hereinafter referred to as a first state. The respective rotors 111, 211 and 311 are located in the positions corresponding to the rotation angles of the output adjustment knobs (FIG. 6). By rotating the second output adjustment knob 201 clockwise from the first state in FIG. 4 the rotation force is transmitted through a second operating shaft 204 to a second variable resistor 203, causing the resistive value of the corresponding resistor to be increased to permit the output of the second coil to be increased. In this case, the clockwise rotation of the second operating shaft 204 is transmitted through a second engaging element 205, second pin 208 and second power transmitting element 209 to a rotation shaft 207 to cause a second rotor 211 (FIG. 6) to be rotated in a clockwise direction. This causes the oil in the second oil chamber 212 to be pushed from an oil supply hole 215 toward the communication pipe 403. In this case, the oil tends to enter the first and third oil chambers 112 and 312. However, an adjustment knob 301 of a third variable resistor 303 is in the 0 (=OFF) position and makes no further counterclockwise rotation. Since a rotor 311 in contact with the knob 301 is not rotated in a counterclockwise direction, the oil does not enter into an oil chamber 312. As a result, the oil enters into the first oil chamber 112 by an amount corresponding to an outflow of oil from the second oil chamber 212, causing the first rotor 111 to be rotated in a counterclockwise direction. The rotation force is transmitted from the first rotation shaft 107 through the first engaging pin 108, first engaging element 105 etc. to the first operating shaft 104, thereby decreasing the resistive value of the first variable resistor 103 and causing the first output adjustment knob to be rotated in a counterclockwise direction. At this time, an amount of rotation (counterclockwise) of the first output adjustment knob 101 is made equal to an amount of rotation (clockwise) of the second output adjustment knob 201. Therefore, when the second output adjustment knob 201 is clockwise rotated through an angle of 45° from the first state in FIG. 4 to obtain a rotation angle of 90° and an output of $W_O/2$, the second coil 3, the first output adjustment knob 101 is counterclockwise rotated through an angle of 45° C to obtain a rotation angle of 90° and an output of $W_O/2$ (the first coil 2). In this case, the rotation angle of the third output adjustment knob 301 is held at 0° and in consequence the output of the third output coil is held at a "0" level. That is, the respective knob is set to a second state.

When the third output adjustment knob 301 is clockwise rotated from the second state, the third resistor 303 is adjusted through a third operating shaft 304, thereby increasing a resistive value. The rotation (clockwise) force of the third operating shaft 304 is transmitted through the third engaging element 305, third engaging pin 308 etc. to a rotation shaft 307 to cause the third rotor 311 to be rotated in the clockwise direction. As a result, the oil is pushed out of the third oil chamber 312 and tends to enter the second and first oil chambers 212 and 112 through the communication pipe 403. Since at this time the reaction forces of the second and first rotors 211 and 111 to oil pressure are equal, the rotors 211 and 111 are counterclockwise rotated by oil pressure transmitted from the third oil chamber 312 and a fraction of oil corresponding to half the outflow of oil from the third oil chamber 312 enters into the respective oil chambers 212 and 211. The rotation forces of the rotors 211 and 111 are transmitted respectively from the rotation shafts 207 and 107 to the knob operating shafts 204 and 104, thereby decreasing the resistive values of the variable resistors 203 and 103 and rotating the respective output adjusting knob 201 in the counterclockwise direction. At this time the rotation amount of the second and first output adjustment knobs 201 and 101 is equal to half the rotation amount of the third output adjustment knob. Therefore, when the third output adjustment knob 301 is clockwise rotated through an angle of 90° from the second state to obtain a rotation angle of 90° and an output of $W_O/2$ (the third output coil 4), the second output adjustment knob 201 is counterclockwise rotated through an angle of 45° to obtain a rotation angle of 45° (angle from OFF position) and an output of $W_O/4$ (the second output coil 3). The first output adjustment knob 101 is counterclockwise rotated through an angle of 45° to obtain a rotation angle of 45° (angle from OFF position) and an output of $W_O/4$ (the first output coil). As a result, each knob is set to the third state.

When the third output adjustment knob 301 is counterclockwise rotated through an angle of 45° to obtain an output of $W_O/4$ (the output coil 4), the third operating shaft 304 is rotated in the counterclockwise direction to cause a third engaging element 305 to be moved away from the third engaging pin 308. As a result, the rotation force is not transmitted to the third rotation shaft 307 and since the third rotor 311 is at the third state the other output adjustment knobs 101 and 201 are maintained at the third state. As a result, the rotation angles of the first, second and third output adjustment knobs are set at 45° from the OFF position and the outputs of the first, second and third output coils are $W_O/4$, respectively. The respective output adjustment knobs are set at the fourth state.

When the first output adjustment knob is clockwise rotated from the fourth state, the rotation force is transmitted from the first operating shaft 104 to the first rotation shaft 107 to cause the rotor 111 to be rotated in a clockwise direction. For this reason, oil pressure is applied to the second and third rotors 211 and 311 and since the third engaging pin 308 is located 45° away from the third engaging element 305 the reaction force of the third rotor 311 to the oil pressure is smaller than the reaction force of the second rotor 211. As a result, only the third rotor 311 is rotated in the counterclockwise direction. In this case, when the clockwise rotation of the first output adjustment knob 101 is within 45° no influence is exerted on the rotation of the second output adjustment knob 201. If the clockwise rotation of the first output adjustment knob 101 exceeds 45°, the second and third output adjustment knobs are counterclockwise rotated by an amount corresponding to half the excess amount of clockwise rotation of the first adjustment knob 101. As explained above, the interlocking mechanism 400 is so automatically controlled that a sum of the rotation angles (angle from OFF position) of the respective output adjustment knobs does not exceed 180° (from the reference point). Thus, the interlocking mechanism 400 acts as the total output regulating device.

When in the above-mentioned interlocking mechanism the first and second output adjustment knobs are set to 0°, it is not that the first and second monomultivibrators 25 and 28 do not entirely generate pulses. The first and second monomultivibrators are so designed as to generate a trigger pulse for starting the next stage main monomultivibrator.

When the output adjustment knobs are of a slide type as shown in FIG. 7, a slide type interlocking mechanism 500 as shown in FIG. 9 may be used. The interlocking mechanism 500 will be briefly explained below.

Each slide type variable resistor 503 has an operating shaft 502 to one end of which an output adjustment knob 501 is fixed. Each slide shaft 505 has one end abutted against the operating shaft 502 and the other end fixed to a piston 504. The slide shaft 505 can be slidably moved. The piston 504 can be reciprocatingly moved relative to an elongated cylinder 506 into which an oil is filled. The respective cylinders 506 communicates with each other through a communication pipe 507. The arrangement permits the total displacement of the respective output adjustment knobs 501 to be always set to below a certain amount. This arrangement works in the same way as the rotary type interlocking mechanism 400.

Although in the above-mentioned embodiment the transistors are used as the inverter circuit, this invention is not restricted thereto. For example, thyristors are used in place of the transistors. Although in the above-mentioned embodiment three output coils for induction heating are used, the invention is not restricted thereto.

The inverter circuit and output coil selection circuit in FIG. 2 can be modified, for example, as shown in FIG. 10 where like reference numerals are employed to designate like parts. The outputs of a current switching type inverter circuit 34 is connected to mutually mechanically coupled levers $\mathbf{35}_{d1}$ and $\mathbf{35}_{d2}$ of a first relay circuit 35. The lever $\mathbf{35}_{d1}$ is switched between a normally open contact $\mathbf{35}_{a1}$ and a normally closed contact $\mathbf{35}_{b1}$ and the lever $\mathbf{35}_{d2}$ is switched between a normally open contact $\mathbf{35}_{a2}$ and a normally closed contact $\mathbf{35}_{b2}$. Mutually mechanically coupled levers $\mathbf{36}_{d1}$ and $\mathbf{36}_{d2}$ of a second relay circuit 36 are connected to the normally closed contacts $\mathbf{35}_{b1}$ and $\mathbf{35}_{b2}$ of the first relay. The lever $\mathbf{36}_{d1}$ is switched between a normally open contact $\mathbf{36}_{a1}$ and a normally closed contact $\mathbf{36}_{b1}$ and the lever $\mathbf{36}_{d2}$ is switched between a normally open contact $\mathbf{36}_{a2}$ and a normally closed contact $\mathbf{36}_{b2}$. A first output coil 2 is connected to the normally open contacts $\mathbf{35}_{a1}$ and $\mathbf{35}_{a2}$, a second output coil 3 is connected to the normally opened contacts $\mathbf{36}_{a1}$ and $\mathbf{36}_{a2}$, and a third output coil 4 is connected to the normally closed contacts $\mathbf{36}_{b1}$ and $\mathbf{36}_{b2}$. The operation of the inverter circuit 34 and the first and second relay circuit will be easily understood from the explanation of FIG. 2 and further explanation will be omitted.

What we claim is:

1. An induction heating apparatus comprising:
an inverter circuit;
a plurality of output coils for induction heating;
an output coil selection circuit for selectively connecting said each output coil to the output terminal of said inverter circuit
a control circuit for driving said output coil selection circuit and said inverter circuit so as to cyclically supply an output of said inverter circuit to selected one of said output coils for each predetermined time of a predetermined cycle;
a plurality of output adjusting devices coupled to said control circuit and adapted to set an output period of said each output coil which is included in said predetermined cycle to a desired time period.

2. An induction heating apparatus according to claim 1, wherein each of said output adjusting devices has an output indicating means of a corresponding output coil and said apparatus further comprises a total output regulating device coupled to said output adjusting devices and adapted to effect such a control that a sum of the outputs indicated by said output indicating means of said output adjusting devices does not exceed a predetermined maximum value when the output of any of the output coils is varied.

3. An induction heating apparatus according to claim 2, wherein said total output regulating device includes an interlocking mechanism connected in common to said respective output adjusting devices, responsive to one-direction displacement of the respective output adjusting devices and adapted to cause the respective output adjusting devices to be brought into interlock with each other so that a sum of the output indicated by said output indicating means of said output adjusting device does not exceed said predetermined maximum value.

4. An induction heating apparatus according to claim 3, in which said output adjusting devices are dial type knobs having a pointer for indicating a rotation angle from a reference point, and said interlocking mechanism includes a plurality of liquid baths rotated by the one-direction rotation of the knobs and adapted to cause the volume of a liquid in each bath to be varied, a control pipe through which the liquid baths communicate with each other, and means adapted to, when any one of the knobs are rotated from the reference point, cause the remaining knobs to be rotated in such a manner that a sum of the rotation angles of all the knobs as measured from the reference point does not exceed a predetermined maximum angle.

5. An induction heating apparatus according to claim 1, in which said control circuit includes means for stopping the output of said inverter circuit for a short time between a first output period in which selected one of the output coils is energized by the output of said inverter circuit and a second output period in which the output coil to be next selected is energized by the output of said inverter circuit; and means for energizing said coil selection circuit so as to complete during the stopping period the selection of said output coil to be next selected

6. An induction heating apparatus according to claim 1, in which said output coil selection circuit includes a plurality of relay circuits connected to said inverter circuit, said output coils and said control circuit, each of said relay circuits including a switching means for cyclically switching the output of said inverted circuit to two predetermined output coils, said switching means being controlled by the outputs of said control circuit.

7. An induction heating apparatus according to claim 1, in which said control circuit includes a low frequency oscillator for generating pulses for setting said predetermined cycle, main monomultivibrators equal in number to said output coils and sequentially serially connected to the output terminal of said low frequency oscillator and adapted to sequentially generate an output pulse of predetermined width with the fall time of the output pulse of the low frequency oscillator as a reference, a plurality of subsidiary monomultivibrators having their respective input terminals connected to respective inputs of the corresponding main monomultivibrators and adapted to stop the generation of an output only for a predetermined short time following the rise time of the output pulse of the main monomultivibrator a plurality of AND circuits each adapted to receive outputs of a corresponding pair of said subsidiary and main monomultivibrators, means for supplying outputs of a predetermined number of said main monomultivibrators to said output coil selection circuit, and means for supplying the outputs of said AND circuits to said inverter circuit, said output adjusting devices including adjusting means for adjusting resistive values of variable resistors so as to adjust the width of the output pulse of the corresponding main monomultivibrator.

8. An induction heating apparatus according to claim 7, in which said control circuit further includes means for supplying to the input terminal of a corresponding AND circuit an output of a load detector for detecting the presence of a load for the output coil, thereby stopping energization of unloaded output coils.

* * * * *